US006834949B2

(12) United States Patent
Greive

(10) Patent No.: US 6,834,949 B2
(45) Date of Patent: Dec. 28, 2004

(54) DEVICE FOR SIMULTANEOUSLY HOLDING BY SUCTION AND TRANSPORTING A SHEET

(75) Inventor: Martin Greive, Schönau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/068,636

(22) Filed: Feb. 6, 2002

(65) Prior Publication Data

US 2002/0109768 A1 Aug. 15, 2002

(30) Foreign Application Priority Data

Feb. 6, 2001 (DE) ..... 101 05 552

(51) Int. Cl.[7] ..... B41J 2/01; B65H 29/24; B65H 29/32; B65H 5/00; B65H 5/02

(52) U.S. Cl. ..... 347/104; 347/101; 347/102; 347/20; 347/21; 347/129; 347/134; 347/112; 271/196; 271/194; 271/264; 271/197; 271/276; 271/275; 400/635; 400/634; 400/48; 346/134

(58) Field of Search ..... 347/101, 20, 129, 347/112, 104, 102, 21; 271/196, 194, 264, 197, 276, 275; 400/634, 635, 48; 346/134

(56) References Cited

U.S. PATENT DOCUMENTS 4,463,361 A * 7/1984 Koumura et al. ..... 346/104
5,124,728 A * 6/1992 Denda ..... 346/104
5,225,852 A * 7/1993 Uchida et al. ..... 346/104
5,505,124 A * 4/1996 Esposito ..... 101/142
5,764,264 A * 6/1998 Takanaka ..... 242/562
5,835,106 A * 11/1998 No ..... 347/104
6,038,776 A * 3/2000 Yamada et al. ..... 271/183
6,074,056 A * 6/2000 Kubo et al. ..... 347/104
6,270,215 B1 * 8/2001 Miyasaka et al. ..... 347/104
6,336,722 B1 * 1/2002 Wotton et al. ..... 347/102
6,394,596 B1 * 5/2002 Wotton et al. ..... 226/172
6,409,332 B1 * 6/2002 Yraceburu et al. ..... 271/197

FOREIGN PATENT DOCUMENTS

| | | | |
|---|---|---|---|
| DE | 44 06 739 A1 | 9/1995 | |
| DE | 196 16 714 A1 | 11/1997 | |
| DE | 197 28 056 A1 | 1/1999 | |
| EP | 1 060 897 A2 | 12/2000 | |
| JP | 06055731 A * | 3/1994 | ..... B41J/2/01 |
| WO | WO 99/11551 | 3/1999 | |

* cited by examiner

*Primary Examiner*—Lamson Nguyen
*Assistant Examiner*—Leonard Liang
(74) *Attorney, Agent, or Firm*—Laurence A. Greenberg; Werner H. Stemer; Gregory L. Mayback

(57) ABSTRACT

A device for holding a sheetlike article on a movable underlying surface for transporting the sheetlike article in at least one direction selected from the group consisting of a direction into and a direction out of an operating station having a printing unit, includes a member having a surface underlying the sheetlike article, the sheetlike article being retainable by pneumatic pressure on the surface, a screening device disposed locally fixedly with respect to an operating station, the screening device serving for reducing an airflow in a region of the printing unit at least with respect to adjacent regions, the reduction in the airflow resulting from the sheetlike article being held on the underlying surface.

10 Claims, 4 Drawing Sheets

DEVICE FOR SIMULTANEOUSLY HOLDING BY SUCTION AND TRANSPORTING A SHEET

BACKGROUND OF THE INVENTION

Field of the Invention

The invention of the instant application relates to a device for simultaneously holding by suction and transporting a sheet.

In the field of transport devices, articles which are to be transported are frequently retained by suction or negative pressure on an underlying surface which moves the articles. In this regard, the articles are retained on the underlying surface by a difference in pressure above the article and beneath the underlying surface. In the case of such transport devices, the problem arises that the negative pressure has to act upon the underside of the articles through openings formed in the underlying surface. Further in this regard, marginal regions of flat articles, in particular, should be held firmly on the underlying surface, so that suction holes have to be provided also in and beyond the marginal regions. In particular, in the case of endless belts, individual suction holes are often not firmly assigned to the base surface of the respective article. Furthermore, articles with differing base surfaces are transported, at least serially, on the aforementioned underlying surfaces, so that open suction holes are usually located outside the base surfaces of the articles, and considerable quantities of air flow into suction chambers through the suction holes. Such open suction holes result in considerable pressure losses and in large pressure differences in the marginal regions of the articles, these pressure differences being manifested in correspondingly pronounced airflows.

In order to provide a remedy therefor, the German Published Non-prosecuted Patent Application (DE-OS) 4406 739 has proposed constructing the underlying surface for the articles from a plurality of layers formed with recesses provided with labyrinths for the discharging air, which increase the flow resistance thereto. A more uniform suction force for holding the articles, which is supposed to be effective, in particular, in the marginal regions of the articles, is thereby achieved, the intent thereof being for the reduced flow speed to result in reduced energy requirements. The underlying surface or the transporting belt thus has the same flow resistance over the entire length thereof.

The German Published Non-prosecuted Patent Application (DE-OS) 197 28056 discloses adapting the suction force of the underlying surface to the respective local requirements. In this regard, in the case of sections of the transport belt whereon, in fact, no article is present, a respectively effective negative pressure can be set accordingly. This effect is achieved in a comparatively costly manner in that a multiplicity of suction chambers are arranged beneath the belt and are, respectively, provided with a dedicated negative-pressure source and can be adjusted in terms of suction capacity in accordance with the respective requirements.

The aforedescribed airflow is particularly pronounced and disruptive when flat articles travel into a flat operating station. This is true, for example, for the passage of paper sheets into a printing unit, in particular, an ink-jet printer. Such sheets have a surface area with which they cover a relatively larger region, respectively, of the underlying surface. The respective sheet closes the suction holes directed towards the bottom surface thereof, with the result that a considerable differential pressure, by which the sheet is pressed against the underlying surface, is produced in this region. The suction holes which are not covered, in particular, immediately outside the border or margin of the respective sheet, can be adapted well to the airflow, with the result that a comparatively low differential pressure prevails thereat. These pressure differences, which are noticeable in the marginal region of the flat article, in particular, produce considerable airflows and vortices, which may frequently have disadvantageous consequences for the functioning of the operating stations. This is the case, for example, with printing units wherein the airflow adversely affects the ink which is to be applied to the sheet, i.e., the printing operation. In particular, if the printing head is arranged at only a slight distance above the sheet, the slight distance results in considerable flow speeds, in particular, at the sheet margins, which adversely effect the application of the ink to the sheet specifically in the marginal regions of the sheet, for example, in that the ink is applied over the sheet with different levels of dampness or, for example, in the case of an ink-jet printing unit, ink droplets are whirled about in a vortex and thus adversely affect the printed image at least in the marginal regions of the sheet.

SUMMARY OF THE INVENTION

Starting from the device for simultaneously holding by suction and transporting a sheet as described in general in the introduction hereto, it is an object of the invention of the instant application to provide a straightforward improvement in the construction thereof so that, upon the occurrence of a negligible reduction in the holding force of the underlying surface, the airflows occurring in a respective printing unit are largely reduced.

With the foregoing and other objects in view, there is provided, in accordance with the invention, a device for holding a sheetlike article on a movable underlying surface for transporting the sheetlike article at least in one direction selected from the group thereof consisting of a direction into and a direction out of an operating station having a printing unit, comprising a member having a surface underlying the sheetlike article, the sheetlike article being retainable by pneumatic pressure on the surface, a screening device disposed locally fixedly with respect to an operating station, the screening device serving for reducing an airflow in a region of the printing unit at least with respect to adjacent regions, the reduction in the airflow resulting from the sheetlike article being held on the underlying surface.

In accordance with another feature of the invention, the printing unit is an ink-jet unit.

In accordance with a further feature of the invention, the underlying surface is on a movable belt formed with through-passage holes.

In accordance with an added feature of the invention, the screening device has a sheet-like mesh formed with holes and disposed beneath the underlying surface, the holes of the mesh being of such number and size that, as a result of flow resistance thereof, there is an adequate reduction in the airflow in the region of the printing unit.

In accordance with an additional feature of the invention, a virtually limited first suction chamber is disposed beneath the region of the printing unit, the screening device having a throttle opening via which the first suction chamber is connected to a negative-pressure source.

In accordance with yet another feature of the invention, the holding and transporting device includes further suction chambers connected to the negative-pressure source, the further suction chambers being located adjacent to the first suction chamber and having a greater negative pressure than that of the first suction chamber.

In accordance with yet a further feature of the invention, the mesh is disposed beneath a cover plate formed with pass-through openings, the cover plate covering the suction chambers and serving for guiding the belt.

In accordance with yet an added feature of the invention, the mesh is connected to the cover plate.

In accordance with yet an additional feature of the invention, the connection of the mesh to the cover plate is selected from the group thereof consisting of integral and releasable connections.

In accordance with still another feature of the invention, the underlying surface is on a continuous transport belt formed with holes around the length thereof and guidable in given sections by the cover plate.

In accordance with a concomitant feature of the invention, the pneumatic pressure is at least one pressure selected from the group thereof consisting of positive and negative pressures.

By calling for the feature of the locally fixed or stationary screening device, the airflow is reduced to a pronounced extent precisely in the regions wherein the printing operation takes place. In the regions which surround those regions, by contrast, the airflow is increased, which is a result of the pressure losses avoided by the screening device.

The invention of the instant application may advantageously be used for a large number of different printing processes wherein airflows may result in the printed image being impaired. In the case of an ink-jet printer, the paper sheet is transported beneath an ink-jet printing head and, in the process, the ink is sprayed onto the paper via corresponding nozzles. For reasons of quality, the distance between the paper sheet and the printing head has to be kept very small, as a result of which the speed of the airflow is increased further. By the sucking of the paper sheet against the underlying surface, in particular in the marginal or border region of the paper sheet, beneath the ink-jet printing head, vortices which adversely affect the printing quality are formed. This results from the flow of air beneath the printing head from all sides. If a sheet then passes beneath the printing head, the flow beneath the head is changed to a pronounced extent. Airflows are then also produced over the paper surface, which result in the flying droplets of ink being deflected. This can be seen particularly at the margins or borders when the paper sheet runs in and out beneath the ink-jet printing head. The screening device according to the invention reduces the detrimental vortices to a minimum.

Frequently, the printing unit of an ink-jet printer includes several printing heads arranged at a suitable location above the sheet which has come in, it being possible for each printing head to be provided again with a very large number of individual nozzles, from which the ink is then sprayed onto the sheet. Because the individual printing heads may be distributed with large spacings above the sheet which has come in, the details given above in relation to a printing unit also apply, respectively, in relation to the individual printing heads. In this case, the individual heads may be regarded, within the context of the invention, as spaced-apart printing units. A dedicated screening device may then be assigned to each of the individual printing heads.

A whole range of possibilities are available for a suitable underlying surface in the holding and transporting device according to the invention. The underlying surface may be formed as a grid or a grate which transports the sheetlike article and the sheet, respectively, forward into the printing unit and then back again. If a paper sheet is assigned so as to be in a fixed position relative to the underlying surface, then it is also possible for the screening device to be incorporated directly into the underlying surface. Assurance must then be provided that the individual screening devices be located beneath the individual printing heads, respectively, during the printing operation.

A range of embodiments is also conceivable with regard to the screening device. It is thus possible for a screening device to be constructed, for example, as a shield which acts counter to the airflow and encloses the printing head, at least in certain regions, above the underlying surface. Assurance should be provided, however, that, as a result of the slit produced between the screen and the paper sheet, the flow speed of the air is not increased, which would then result in a more rapid airflow passing beneath the printing head. The mesh may be formed as a perforated metal plate, the holes having to be small enough in order to achieve the desired screening effect. The size of the mesh in relation to the printing region is also important. Because, in particular, the marginal or border region of the paper sheet is to be protected when it passes in beneath the printing head, assurance must be provided that the marginal region which is to be printed is protected by the action of the screen arrangement. This means that the screen has to be drawn an adequate distance forward over the printing region in the transporting direction of the paper sheet. This applies as well to the trailing margin.

Frequently, a sheet is printed simultaneously by a plurality of printing heads of the printing unit provided with ink-jet printing heads. It is possible for the position of the printing heads to be quite different during the various print runs, the printing heads being moved into a different position in order to print the new print run. It may he advisable here for the locally fixed or stationary screening devices to be arranged in a releasable manner, for example, by releasably suspending the meshes at suitable locations from the underlying surface.

Because it is a goal according to the invention to attain a reduced airflow in the printing region of the printing unit or printing head, this can also be achieved by a considerable reduction in the suction pressure in the region of the printing head or printing unit. Assurance must be provided then that the side walls of the relevant suction chamber limit or bound the printing region which is to be protected. The throttle causes the airflow to be reduced thereat. Because the mesh only allows a reduced airflow to pass through anyway, it is expedient for the space beneath the mesh to have a reduced suction pressure.

It is possible for further negative-pressure chambers to be arranged around the suction chamber and negative-pressure chamber, respectively, forming a screening arrangement or device, an increased negative pressure, possibly originating from a central negative-pressure source, being fed to the further chambers. Thereby, in a very simple manner, regions with different suction pressure are located beneath the underlying surface. Individual pressure sources according to the prior art, which can be regulated independently of one another, are unnecessary for this purpose.

It has already been explained hereinabove that it may be advantageous to integrate the screening device and/or the mesh in the underlying surface. However, it may also be recommended, that the individual functions be divided up between different components. For this purpose, use is made of a cover plate which covers the suction chambers or the suction chamber (if only a single chamber is provided) and upwardly limits or bounds them. However, the cover plate, rather than just limiting or bounding the suction chamber, also guides the belt at the same time. In order to allow the suction pressure to take effect above the belt, the cover plate is also provided with pass-through openings, so that air can pass successively through the through-passage holes formed in the belt, the pass-through openings formed in the cover plate and the holes formed in the mesh.

The mesh may be integrated in the covering plate by introducing the narrow holes of the mesh into the relevant region of the cover plate. On the other hand, however, it is also advantageous in certain circumstances for the meshes to be fitted in corresponding openings of the covering plate, for example, when those regions of the printing unit or of the printing heads which are to be protected are to be established at different locations in accordance with the different print runs which are to be printed. This makes it possible for the meshes to be changed over in accordance with the desired print run, in which case the number of meshes used need not remain the same.

In the case wherein a revolving transport belt is formed with the underlying surface, the individual paper sheets are not usually in any defined position in relation to the transport belt. As a result, the holes formed in the transport belt are of the same size and are spaced apart from one another at least approximately a like distance in the longitudinal direction of the belt. If use is made of a cover plate, then the dimensions of the pass-through openings thereof may depend upon the position of the openings in relation to the respective printing region and/or the position of the relevant printing head. It is thus possible, for example, to select relatively small dimensions for the pass-through openings in the regions of the printing heads, while, conversely, large pass-through openings are used outside those regions.

Other features which are considered as characteristic for the invention are set forth in the appended claims.

Although the invention is illustrated and described herein as embodied in a device for simultaneously holding by suction and transporting a sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
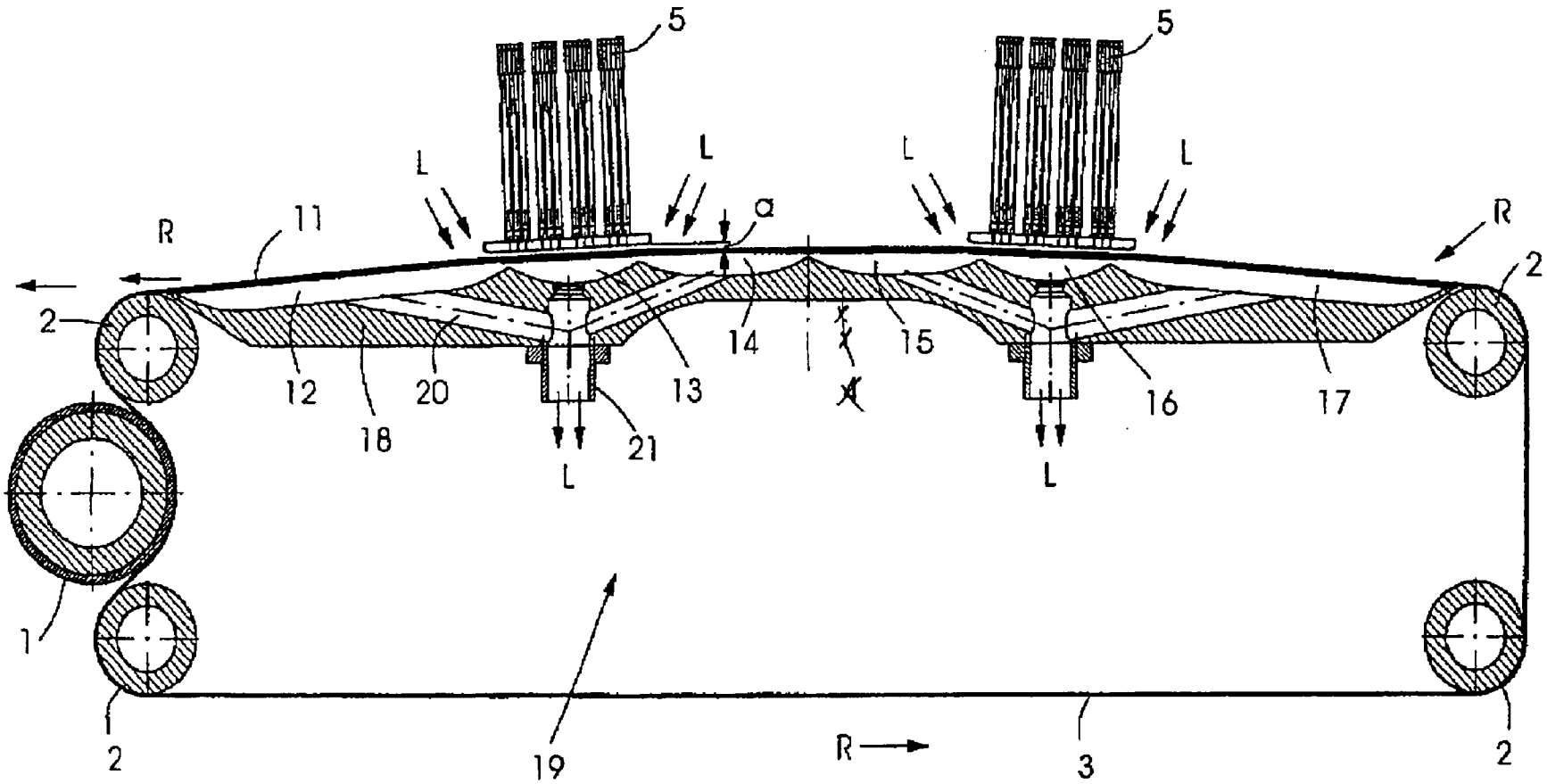
FIG. 1 is a diagrammatic longitudinal sectional view of the device for simultaneously holding by suction and transporting a sheet in accordance with the invention, the device being provided with an endless transport belt, above which printing heads are arranged.

Referring now to the drawings and, first, particularly to FIG. 1 thereof, there is illustrated therein a drive roller 1 for driving a transport belt 3 which is wrapped around four deflecting or diverting rollers 2. The drive roller 1 is driven uniformly by a non-illustrated drive, for example, an electric motor, so that the drive roller 1 revolves continuously during the printing operation. Paper sheets, which are not shown in FIG. 1, are located on the top section or taut belt strand 11 of the transport belt 3 during the printing operation, the paper sheets moving on the belt strand 11 in FIG. 1 from the righthand side to the lefthand side in the direction of the arrows R. Two printing heads 5 are also shown in FIG. 1, above the belt strand 11, these printing heads 11 being spaced a very slight distance from the transport belt 3 and thus, consequently, from the non-illustrated paper sheets disposed thereon. These printing heads 11 may have several hundred nozzles and may thus be of considerable dimensions.

Figure 3:
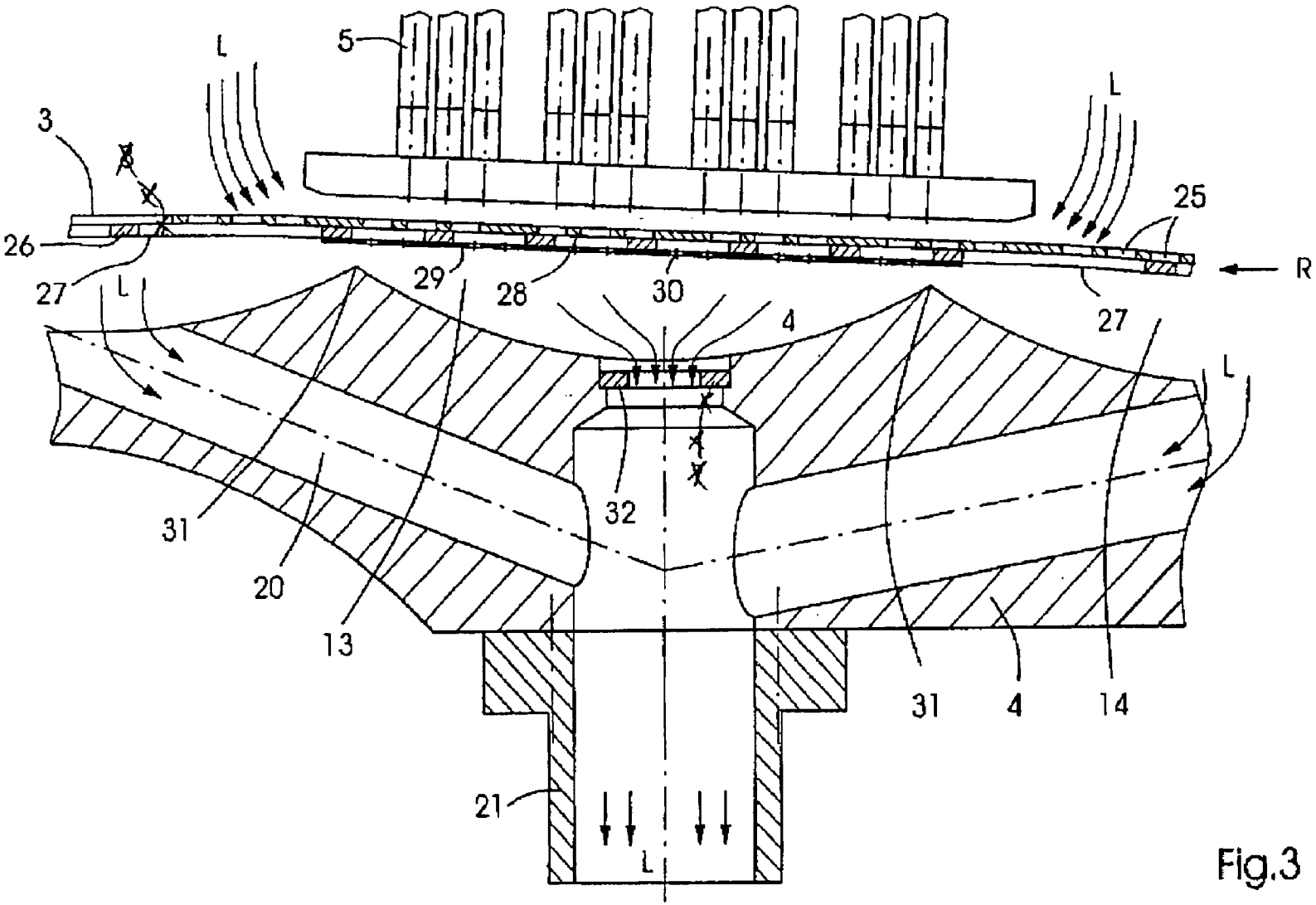
FIG. 3 is an enlarged fragmentary view of FIG. 1.

The paper sheets are held on the transport belt 3 by suction pressure which is transmitted to the transport belt 3 from trough-shaped suction chambers 12 to 17 located beneath the transport belt 3. For the suction pressure, starting from the suction chambers 12 to 17, to be able to pass through the transport belt 3 to the bottom surface of the paper sheets, the transport belt 3 is formed with through-passage holes 25, as is shown in FIG. 3, for example. FIG. 1 illustrates, beneath the belt strand 11, a chamber housing 18 which, at the upper end thereof, is formed with recesses limiting or defining the trough-shaped suction chambers 12 to 17. A negative-pressure source 19, otherwise not illustrated in detail in FIG. 1, for example, formed as a fan, blower or a suction pump, is located beneath the chamber housing 18. Air present in the suction chambers 12 to 17 is removed by suction, by way of the negative-pressure source 19, via connecting lines 20. The connecting lines 20 are connected to the negative-pressure source 19 via connection stubs 21.

Because the transport belt 3 is provided with through-passage holes 25, outer air can pass through the holes into the suction chambers 12 to 17, the paper sheet and sheets, respectively, being retained or held on the transport belt 3 by suction action. Thus, an airflow, represented by the arrows L in FIG. 1, may be observed running from the upper side of the belt strand 11 to the suction chambers 12 to 17, if the path of the airflow is not blocked by paper sheets located on the transport belt 3.

As is apparent from FIG. 1, the undersides of the printing heads 5 are spaced only a slight distance a from the upper side of the transport belt 3. In the case of a prior-art device which has not been provided with the construction of the invention of the instant application, the air then passes along the arrows L into the interspace a, so as to be able to pass through the holes formed in the transport belt 3, which are located in this region, and into one of the two suction chambers 13, 16. Due to the narrowness of the interspace a, the airflow L assumes a considerable speed.

Figure 2:
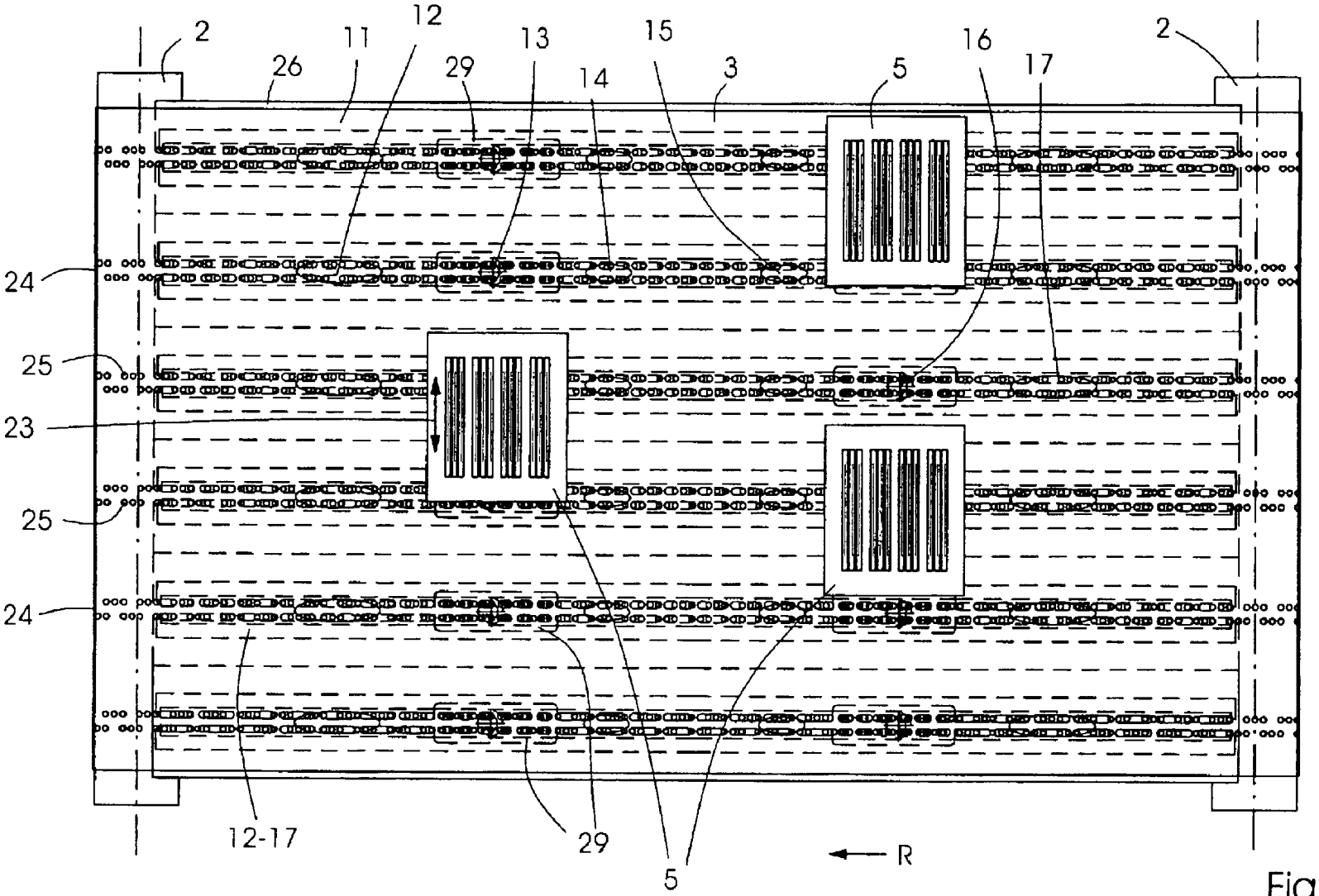
FIG. 2 is a top plan view of FIG. 1.

FIG. 2 is a plan view of the device according to the invention, which is shown in longitudinal sectional view in FIG. 1. The belt strand 11 forming the top section of the transport belt 3 is shown guided over the deflecting rollers 2. Also shown in the plan view of FIG. 2 are a number of printing heads 5 which, in the context of the invention of the instant application, may be regarded as separate printing units which are offset from one another. As is indicated by the double-headed displacement arrow 23, the printing heads 5, at least for a given region, may be displaced in position, for example, for setting up the printing unit for a new print run. The transport belt 3 is provided with six double rows of holes 24, through which the suction pressure can pass to the non-illustrated paper sheets disposed on the transport belt 3. The rows of holes are formed by individual through-passage holes 25, which are shown in sectional view in the transport belt 3 in FIG. 3. As can also be seen from FIG. 3, a cover plate 26, which is provided with pass-through openings 27, 28, is arranged beneath the transport belt 3. In this case, the pass-through openings 28 in the region of the printing heads 5 have a smaller pass-through surface area than the pass-through openings 27 outside this region, as can readily be seen in FIG. 3. This enhances the action of the screening device and the mesh, respectively.

A mesh 29, which is formed with holes 30, is fitted beneath the cover plate 26, approximately level with the printing heads 5, beneath each row of holes 24. The holes 30 are considerably smaller than the pass-through openings 27, 28 of the cover plate 26. As a precautionary measure, in order to be able more easily to arrange the printing heads 5 in a laterally offset manner, a series or line of meshes 29 are installed, which are not absolutely necessary in the case of the construction of the printing head 5 shown in FIG. 2.

FIG. 2 shows the transport belt 3, the cover plate 26 and the mesh 29 disposed above one another, the transport belt 3 moving in the direction of the arrow R relative to the cover plate 26 and the mesh 29, both of which are stationary.

The suction chambers 12 to 17, which run parallel to the rows of holes 24, are also shown in FIG. 3. The suction chambers 12 to 17 are adapted in width to or match the width of the rows of holes 24, with the result that suction pressure is only applied where, by way of openings located thereabove, the suction pressure can also act upon the paper sheet. As can be seen in FIG. 3, the suction chambers, such as the suction chambers 13, 14, for example, have termination edges 31 which extend transversely to the transporting direction R of the transport belt 3 and limit or bound the suction chambers in the longitudinal direction of the belt 3. As has already been explained hereinabove, the depth or width of the suction chambers is adapted to or matches the width of the rows of holes 24 in the transport belt 3. An advantageously important feature in FIG. 3 is a throttle 32, which further helps to reduce the airflow L and the suction pressure in the suction chamber 13.

Figure 4:
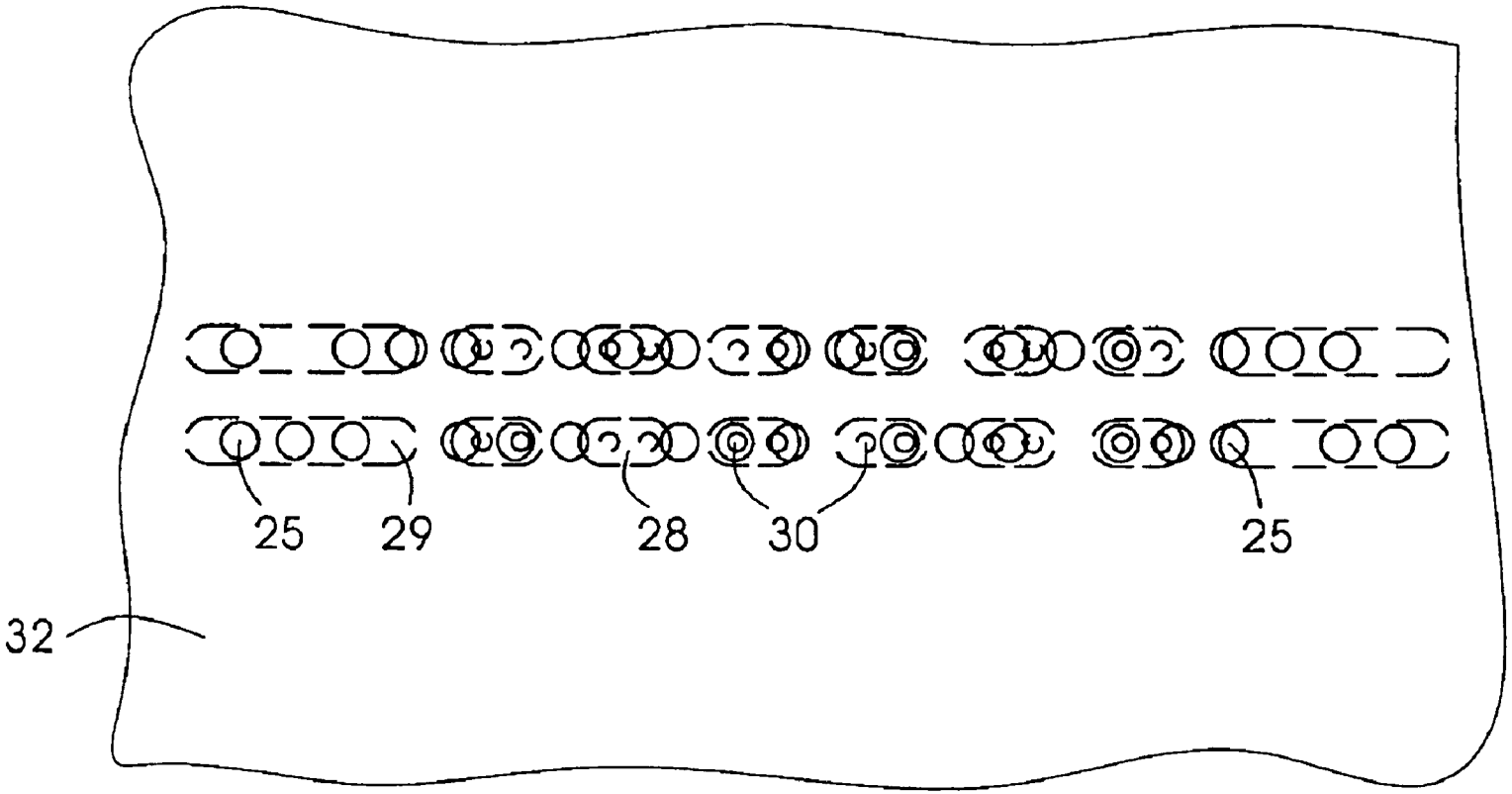
FIG. 4 is an enlarged fragmentary view of FIG. 2 showing through-passage holes, pass-through openings and holes which are located above one another above a suction chamber, and are formed, respectively, in belt, cover-plate and screen sub-assemblies located above one another.

FIG. 4 is a fragmentary plan view of FIG. 2, showing the section 32 cut out of the belt 3 in the region of the printing unit, as well as the through-passage holes 25 formed in the belt 3, the small pass-through openings 28 and the large pass-through openings 27 of the cover plate 26, and the small holes 30 of the mesh 29.

I claim:

1. A device for holding a sheetlike article on a movable underlying surface for transporting the sheetlike article in a transportation direction into or out of an operating station having printing heads, the device comprising:

a negative-pressure source;

a movable belt formed with through-passage holes, said belt having a surface underlying the sheetlike article, the sheetlike article being retainable by pneumatic pressure on said surface; and a screening device disposed locally fixedly with respect to the operating station and having a throttle opening, said screening device serving for reducing an airflow in region of the printing heads at least with respect to adjacent regions, the reduction in the airflow resulting from the sheetlike article being held on said underlying surface, said screening device including:

a cover plate disposed beneath said belt, said cover plate formed with pass-through openings;

a sheet-like mesh formed with holes and disposed beneath said cover plate, the holes of said mesh being of such number and size to cause, as a result of flow resistance thereof, an adequate reduction in the airflow the region of the printing heads;

a virtually limited first suction chamber disposed beneath the region of the printing heads, said first suction chamber being connected to said negative-pressure source via said throttle opening; and further suction chambers connected to said negative-pressure source, said further suction chambers being located adjacent said first suction chamber, said first suction chamber and said further suction chambers having termination edges, said termination edges limiting said first suction chamber and said further suction chambers in the transportation direction, and said further suction chambers having a greater negative pressure than that of said first suction chamber.

2. The holding and transporting device according to claim 1, wherein the printing heads are ink-jet heads.

3. The holding and transporting device according to claim 1, wherein said cover plate covers said suction chambers and serves for guiding said belt.

4. The holding and transporting device according to claim 3, wherein said mesh is connected to said cover plate.

5. The holding and transporting device according to claim 4, wherein the connection of said mesh to said cover plate is a connection selected from the group thereof consisting of integral and releasable connections.

6. The holding and transporting device according to claim 1, wherein said underlying surface is on a continuous transport belt formed with holes around the length thereof and guidable in given sections by said cover plate.

7. The holding and transporting device according to claim 1, wherein said pneumatic pressure is selected from the group thereof consisting of positive and negative pressures.

8. The holding and transporting device according to claim 1, wherein pass-through openings of said cover plate in the region of the printing heads have a smaller pass-through surface area than pass-through openings outside the region.

9. The holding and transporting device according to claim 1, wherein said mesh only applies in areas where the printing heads are located.

10. An ink jet printing unit, comprising:

a movable belt formed with through-passage holes for holding a sheetlike article by suction action and transporting the sheetlike article in a transportation direction;

a printing head disposed above said movable belt for printing the sheetlike article;

a virtually limited first suction chamber disposed beneath said movable belt and a region of said printing head, said first suction chamber having a screening device for reducing an airflow in the region of the printing head;

further suction chambers disposed adjacent said first suction chamber;

said first suction chamber and said further suction chambers having termination edges, said termination edges limiting said first suction chamber and said further suction chambers in said transportation direction;

a negative-pressure source connected to said first suction chamber and said further suction chambers for removing air present in said first suction chamber and said further suction chambers; and said further suction chambers having a greater negative pressure than that of said first suction chamber.

* * * * *